US009067095B2

(12) United States Patent
Vandevelde

(10) Patent No.: US 9,067,095 B2
(45) Date of Patent: Jun. 30, 2015

(54) METHOD AND GAME FOR CYCLISTS

(76) Inventor: John C. Vandevelde, New Lenox, IL (US)

( * ) Notice: Subject to any disclaimer, the term of this patent is extended or adjusted under 35 U.S.C. 154(b) by 177 days.

(21) Appl. No.: 13/698,589

(22) PCT Filed: May 17, 2010

(86) PCT No.: PCT/US2010/035157

§ 371 (c)(1),
(2), (4) Date: Nov. 16, 2012

(87) PCT Pub. No.: WO2011/146047

PCT Pub. Date: Nov. 24, 2011

(65) Prior Publication Data

US 2013/0056935 A1 Mar. 7, 2013

(51) Int. Cl.

| | |
|---|---|
| ***A63F 9/00*** | (2006.01) |
| ***A63B 24/00*** | (2006.01) |
| *A63B 71/02* | (2006.01) |
| *A63B 71/06* | (2006.01) |

(52) U.S. Cl.

CPC ..... *A63B 24/0021* (2013.01); *A63B 24/0084* (2013.01); *A63B 71/02* (2013.01); *A63B 71/0616* (2013.01); *A63B 2024/0025* (2013.01); *A63B 2071/0647* (2013.01); *A63B 2207/02* (2013.01); *A63B 2220/12* (2013.01); *A63B 2220/30* (2013.01); *A63B 2220/806* (2013.01); *A63B 2220/808* (2013.01); *A63B 2220/833* (2013.01); *A63B 2220/836* (2013.01); *A63B 2225/50* (2013.01); *A63B 2225/54* (2013.01); *A63B 2230/06* (2013.01)

(58) Field of Classification Search

USPC ..... 273/244, 441, 445, 446; 340/323 R; 700/90, 91, 92

See application file for complete search history.

(56) References Cited

U.S. PATENT DOCUMENTS

| | | | | |
|---|---|---|---|---|
| 4,875,142 | A | 10/1989 | Spector | |
| 5,812,049 | A * | 9/1998 | Uzi | 340/323 R |
| 6,002,982 | A | 12/1999 | Fry | |
| 7,562,028 | B1 * | 7/2009 | Donner | 705/5 |
| 8,333,643 | B2 * | 12/2012 | Eisner | 463/6 |
| 2005/0288128 | A1 | 12/2005 | Mathews | |
| 2006/0055786 | A1 | 3/2006 | Ollila | |
| 2013/0116809 | A1 * | 5/2013 | Carpenter et al. | 700/92 |

OTHER PUBLICATIONS

USAV Rulebook—USA Cycling—Jun. 24, 2009. www.usacycling.org/news/user/story.php?id=4220 (published on Jun. 24, 2009).*

Racing Rules for Road, Track, and Cyclocross—USA Cycling—2008. Internet: /www.usacycling.org/form/RdTrkCx_rulebook.pdf.*

* cited by examiner

*Primary Examiner* — Nini Legesse

(74) *Attorney, Agent, or Firm* — Charles McCloskey

(57) ABSTRACT

A game for cycling takes place on velodromes, or tracks. The game has three teams competing at the same time to claim victory and advance to higher levels of competition. Each cyclist on a team accumulates points based upon crossing a finish line in the first group of five. Each team has nine members with sprinter and long distance roles. Each team competes in up to ten races during a single game. When teams increase to four in an area, the four teams form a division. After twelve games, the teams and divisions hold a two game playoff that aids in the selection of a national team. The national teams then compete in a worldwide championship game. The game includes select lighting and camera equipment suitable for creating an attractive television product.

1 Claim, 4 Drawing Sheets

METHOD AND GAME FOR CYCLISTS

CROSS-REFERENCE TO RELATED APPLICATION

This application enters the national stage in the United States from the pending international application having the Serial No. PCT/US2010/035157, filed on May 17, 2010 and as amended on Jun. 28, 2011, which has the same inventor.

TECHNICAL FIELD

1. Background of the Invention

The method and game for cyclists generally relates to athletic contests and more specifically to a game with leagues of cyclists.

As in every Olympic sport, cycling operates under a global federation called the Union Cycliste International, "UCI". The global federation includes the national federations for each country. In the United States, USA Cycling, "USAC" is the national governing body, "NGB," for American cyclists.

The sport of cycling takes place in many countries around the world. Cyclists ride upon terrain of all description. The annual Tour de France illustrates the terrain conquered by cyclists and the worldwide appeal of the sport. In nearly every country, some sort of cycling competition exists. However, the cycling competition involves individuals or teams sponsored by companies. Current cycling competitions though lack any league that includes teams representing a city, a region, or a country whether owned privately or publicly.

Cycling has various disciplines within the sport. The Olympic level disciplines include road, mountain biking "MTB" track, and bicycle motocross, "BMX." Road racing has two kinds, races on roads and criterium racing. Road racing is generally the most popular of all of the disciplines of cycling. Teams in road races have sponsorship by large companies seeking to market their brands to the television audience which views the races. Each team has independent ownership. The teams enter each race but effectively lack a season or a path to a championship team, and road cycling has no leagues.

Road racing also includes criteriums which are races held on city streets that range in length from 0.6 mile to 2 miles. These short distance races have become the most popular road race in the United States and in many other countries. During the 1990s, the National Cycling League, "NCL," formed and held criterium races across the country. The NCL pitted city team against city team but without appeal to mass market media, the NCL failed in less than three years. Grand tours and every type of road race have significant costs to arrange, to operate, and to televise because of road permits, street closures, marketing, and media production crews spread across distances. Over the years, the few televised races have just attracted the attention of a few fans, unfortunately not enough to maintain media coverage. Attending a road race in person can be tedious unless fans have a cyclist that they know for whom to cheer. No home teams exist in any segment of the sport.

Cycling also includes track races, the oldest discipline of the sport. The track races generally have individual cyclists and lack professional teams. Track races are generally indoor races held in the winter months and often go by the title of 6 Day races. The 6 Day races have a party or festival like atmosphere with entertainment and beer gardens in the infield of a velodrome, or other cycling track. Beyond the 6 Day races, five world cup races take place in various locales that allow the cyclists to qualify for the Olympics or World Championships. Most other track races are either timed events or too difficult to understand. Alas, most track events do not make for good mass media, particularly television.

However, Keirin racing, or pari-mutual betting, in Japan has had much success. Track races provide the sole cycling discipline suitable for mass media, or television coverage. Track races create a natural stadium like atmosphere as a crowd of fans sits around the track to watch their favorite cyclist or team of cyclists. For a track race, television production costs have much less size than that of a road race. Television product can utilize the newest high definition and digital broadcasting technology available Presently, the cycling tracks of the world, approximately 453 velodromes, have much less utilization than their capacity. The velodromes generally lose money in their operations. The velodromes have many different sizes from 500 meters to 145 meters in length.

Thirdly, cycling includes MTB, an American developed racing discipline. MTB had much popularity at its inception but interest peaked in the late 90's. MTB has had a similar professional and amateur format for individuals and clubs as used in road racing. MTB has been a poor television product. At present, MTB remains the most popular segment of cycling by participation.

Fourth, cycling also includes BMX, the newest discipline of the sport. BMX races take place upon a small man made track usually of sculpted earth in ridges and embankments. BMX has appealed to younger cycling fans and has appeared in the X Games of extreme sports. BMX provides action and drama for television audiences. However, the limited variability in track components leads to redundancy in television audiences. BMX races draw a greater television audience when the races are spaced farther apart. Presently, BMX does not have a professional league but rather only individual races.

2. Description of the Prior Art

Over the years, cyclists and media officials have attempted to organize more cycling races suitable for mass media, particularly television. In the mid 1990's, the NCL held criterium races on city streets across the country. The NCL pitted one city team against another city team. These races lacked appeal to mass market media which lead to the NCL failing in less than three years after its formation.

Another older sport, roller derby, involved skaters upon small tracks usually located indoors. A roller derby usually had two teams competing for prizes at the track but lacked opportunity to advance to higher levels of competition. Roller derby also included teams of both men and women. To often allegations flew of roller derbies being staged. As a game with open competition that led to winners having athletic prowess, roller derby was compromised as a sport.

The present invention overcomes the disadvantages of the prior art and provides a method of organizing cyclists into leagues that fosters competitive races attractive to mass market media. The method places cyclists in teams where three teams compete at the same time to win a game. The cyclists have various lights upon their helmet that show their status to fans at a velodrome or at home via television.

SUMMARY OF THE INVENTION

Generally, this invention of a game for cycling takes place on velodromes, or tracks. In time, the game may be played upon large open surfaces including playgrounds and running tracks. This game starts with teams of a single gender and may expand to mixed teams. This game has three teams competing at the same time to claim victory in the game and advance to higher levels of competition. A three way competition lowers operating costs for the team and velodrome owners. The teams have a smaller number of cyclists than in a two team competition. The three way competition also keeps the outcome of every game above reproach.

As previously described cycling lacks continuity between athletes and teams except for the world cups in their respective disciplines. In every discipline of cycling, the same relationship remains between the governing bodies within the sport and its teams, athletes, and the officials. The UCI governs the national federations which consist of the amateur clubs and professional teams, both hold licenses from the governing bodies as needed. The promoters and velodrome operators obtain official sanction to run the races from the same governing entities. Throughout the licensing process, no mention occurs of a league unifying one team to another or one rider to another. In every facet of cycling, each owner runs an independent team and hires his own athletes without any draft or qualifying system.

The game of this invention serves as a component in a league. The league has a tradename of international fast track cycling league, "IFTCL." The IFTCL has a unified draft system that has a combine where team owners and managers evaluate cycling talent and provides the team owners an opportunity to bid and to select cyclists for their teams. The IFTCL has a main goal of a made for television product that blends with the other audience attractive components of cycling.

Initial research has found approximately 453 velodromes, or tracks, around the world. The majority of these tracks serve multiple purposes beyond cycling. The larger tracks, 400 meters and longer, also have soccer fields, athletic tracks, and ice skating rinks in the infield, which satisfies municipal tax payers who primarily fund the tracks. In the past, the UCI encouraged these large velodromes to hold National, World and Olympic Championships. A championship includes motor pacing, and derby races. However, those events have gone, and now cycling has timed events. Further, the UCI has dictated that every WC and Olympic games shall be conducted upon a 250 meter covered track. Of all 453 velodromes in the world, excluding the 70 Japanese tracks for pari-mutual betting, hundreds of velodromes have little if any profit. The velodromes have difficulty reach a profit because of underutilization. Unfortunately, track racing has the least following of fans in the cycling sport.

There has thus been outlined, rather broadly, the more important features of the invention in order that the detailed description thereof that follows may be better understood and that the present contribution to the art may be better appreciated. The present invention also includes select rules for races, games, and leagues, lighting upon cyclists' helmets, a camera upon each cyclist's bike, a wireless earpiece for each cyclist, and a data transponder that measures various physical data of each cyclist. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a method and game for cyclists suitable to formation of leagues that heighten competition.

Another object is to provide such a method and game for cyclists that utilizes existing velodromes.

Another object is to provide such a method and game for cyclists that improves the revenue and profit of existing velodromes.

Another object is to provide such a method and game for cyclists that provides material suitable for television.

Another object is to provide such a method and game for cyclists that has a low cost of deployment so that the team owners, managers, officials, and cyclists can readily follow the method and game utilizing existing supply sources, or portable velodromes as forecasted growth in the teams and leagues occurs.

Another object is to provide such a method and game for cyclists suitable for the sale of franchises for select geographic territories.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
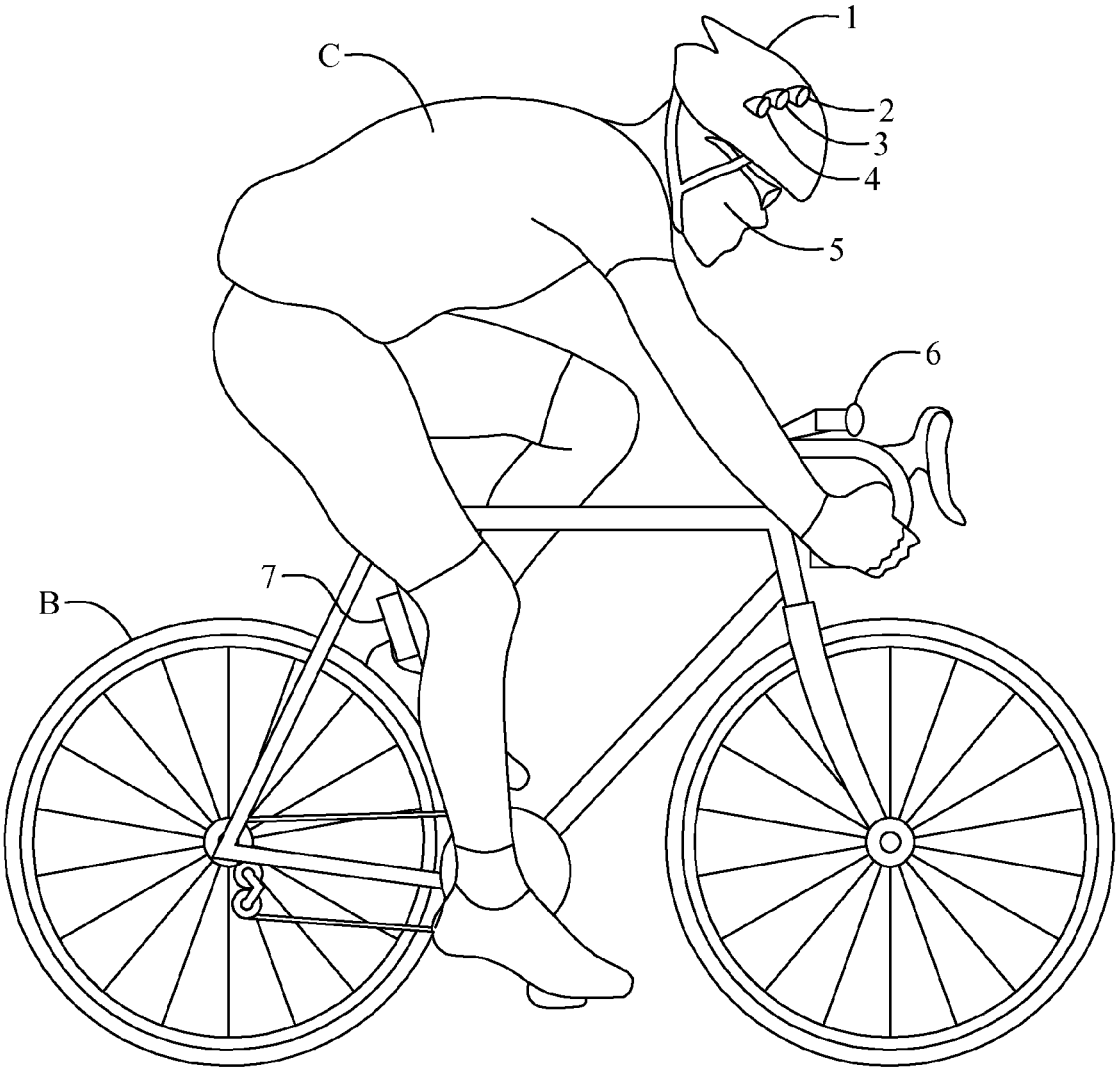
FIG. 1 shows a side view of a bicycle and cyclist equipped with devices for the present invention.

The present art overcomes the prior art limitations by providing a method and game for cyclists that stimulates competition through leagues. The game allows cyclists C to ride their existing bicycles however, the game has select adaptations to equipment as follows and as shown in FIG. 1. Each bicycle B has a cigar shaped camera 6 and a transponder 7 or an equivalent weight placed on the bike at the discretion of the television producer. Each bicycle in the game has a league provided hub and cell phone transponder by Cycleops® of Saris Cycling Group, Madison, Wis., or equivalent. The transponder measures each cyclist's heartbeat, crankshaft speed in rpm, and crankshaft wattage. Wattage is calculated from torque imparted to the rear wheel and crankshaft speed measured at the rear wheel hub. These measurements then transmit over the transponder to the television production equipment for display on the television program as selected by the producer. The transponder also transmits to a receiver for each team manager. Each bicycle has two wheels B-1 generally aligned though spaced apart upon a frame with handlebars towards the front wheel and a seat towards the rear wheel. Each wheel has a hub and a rim B-2 outwardly from the hub. Most wheels have spokes however, a few wheels have a solid construction. As later described, the rims have coloration for each team in certain races.

Additionally, each bicycle includes a tracking device that determines the position and velocity of the cyclist upon the bicycle. The tracking device provides its position using radio waves or laser light to receivers with the television production crew and the team managers. The tracking device emits electromagnetic radiation at frequencies that do not injure or harm cyclists, managers, or spectators. The tracking devices include chips or badges worn by cyclists upon their persons or their clothing during a race or alternatively upon the bicycle. One such tracking device includes global positioning satellite technology where the tracking device calculates its position and velocity based upon signals emitted from the GPS satellite constellation. Velodrome operators in coordination with league officials and team managers will identify velodromes with structures, such as walls and roofs, which inhibit GPS signals so that teams may use alternate tracking means. Each bicycle in the game has a maximum weight of twelve pounds including the camera, transponder, wiring, and power supply. Each bicycle also has the cyclist's number on the top tube in the front of the bicycle and under the bicycle seat facing rearwards, that is, opposite the handlebars. The camera can acquire the cyclist's number for display along with the measurements as selected by the producer.

Each cyclist then has a league distributed earpiece 5 for wireless communication to a team manager. Preferably, the earpiece communicates one way from the team manger to the cyclist wearing the earpiece. Alternatively, the earpiece supports two way communications between the cyclist and the team manager. The operators of a velodrome will terminate wireless communications between cyclists and managers for the last lap of a race. Each cyclist must wear a league provided helmet 1.

Each helmet has a top generally above the head of a cyclist, two sides beneath the top generally along side the cyclist's head proximate the cyclist's ears, and a rear generally joining the sides and positioned opposite the face of the cyclist and beneath the top. Each helmet includes three integral lights on the top and the rear in the colors of white 2, red 3, and green 4. These lights designate different aspects of the races to the television producers, television viewers, race officials, managers, cyclists, and spectators. For example, at the start of a Miss & Out race every cyclist's helmet has the green light illuminated. When a cyclist crosses the start line last of all the cyclists, that cyclist's helmet immediately illuminates the white light. Further, in a double elimination race when the same cyclist crosses the start line last, the cyclist's red light illuminates which indicates that the cyclist is out of the race. Alternatively, the lights 2, 3, 4 have a position upon the handlebars of the bicycle. The white light 2 is generally centered upon the handlebars proximate the stem into the frame. The green light 4 is generally towards the cyclist's left of the handlebars, while the red light 3 is generally towards the cyclist's right of the handlebars.

To provide for a common tie between cyclists in a game and in a league, the game has uniforms for each cyclist in the game. Each cyclist wears a jersey in a team color or pattern, and pants. Every uniform has a twelve inch number, or alternatively a letter, affixed on the back of the jersey and a four inch tall number affixed on each shoulder of the jersey. Preferably the identifying numbers are sewn upon the jersey, alternatively an adhesive or appliqué may affix the numbers to a jersey. Alternatively, each cyclist has an identifying number upon a plate suspended beneath the seat of the bicycle facing the rear wheel. In a Madison event, each member of a cycling team wears a vest of a different shade of color of their team with their number on the back. Alternatively in Madison and relay events, each cyclist of a cycling team has wheel rims of the same color. The wheel rims have colored edges proximate the tires or edges and a colored surface proximate the spokes. This coloration of wheel rims aids the team managers and the audience to identify the various cycling teams in the crowded relay track environment. More particularly, team logos are affixed upon the chest of the jersey and the helmet without obscuring the lights. Upon the back of the jersey, a main sponsor or a junior sponsor may apply its name or logo. The main sponsor of a team may place their logo on the outside of the legs of cycling pants.

Figure 2:
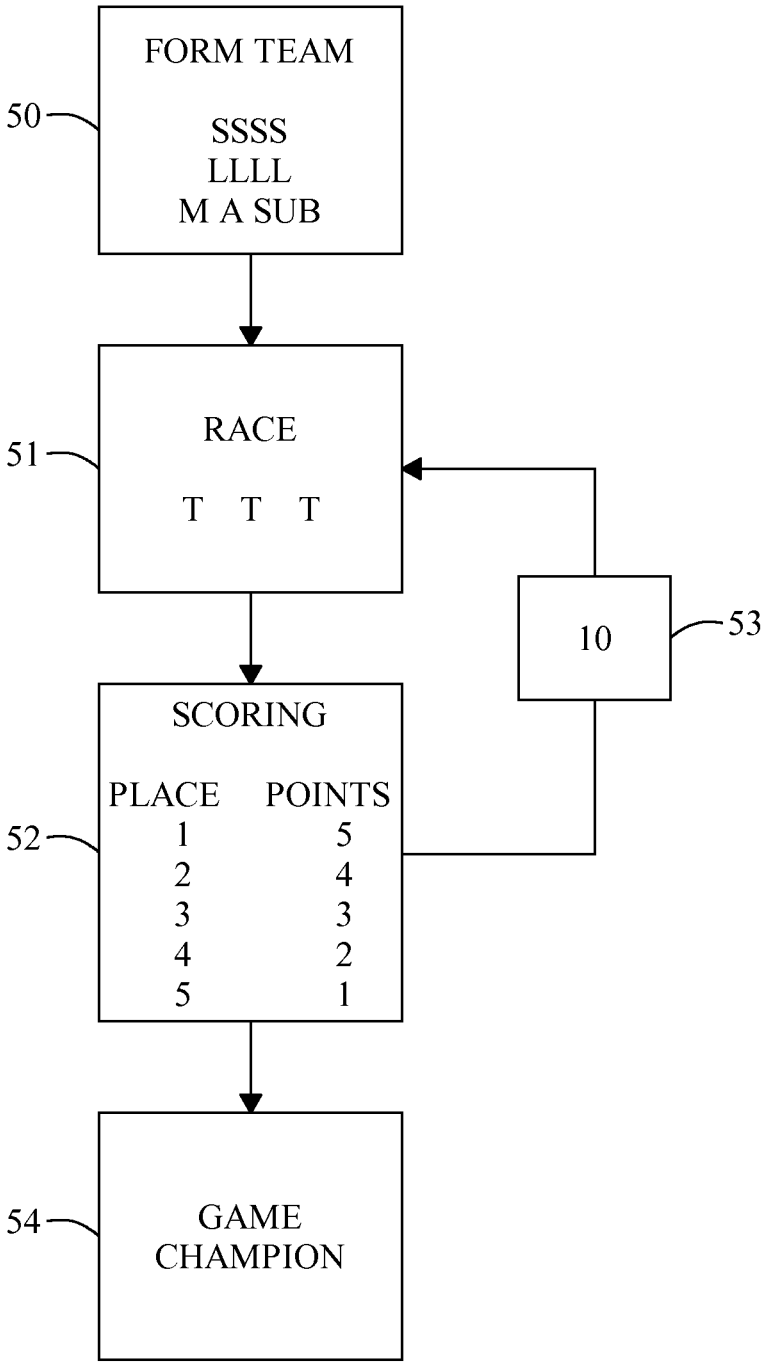
FIG. 2 describes a flow chart of the steps to form a team and to race teams for the present invention.
Figure 3:
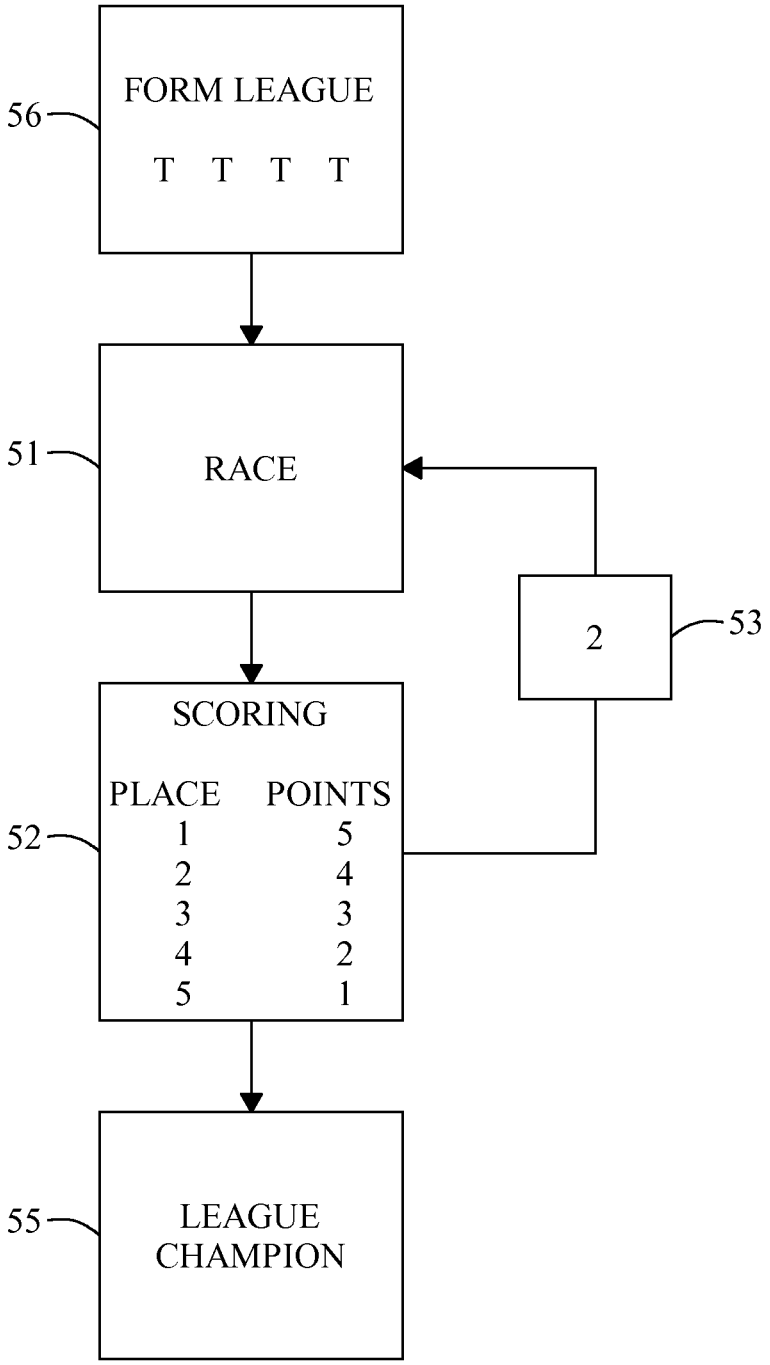
FIG. 3 provides another flow chart to form a league for the present invention; and, FIG. 4 provides a flow chart for a world championship for the present invention.
Figure 4:
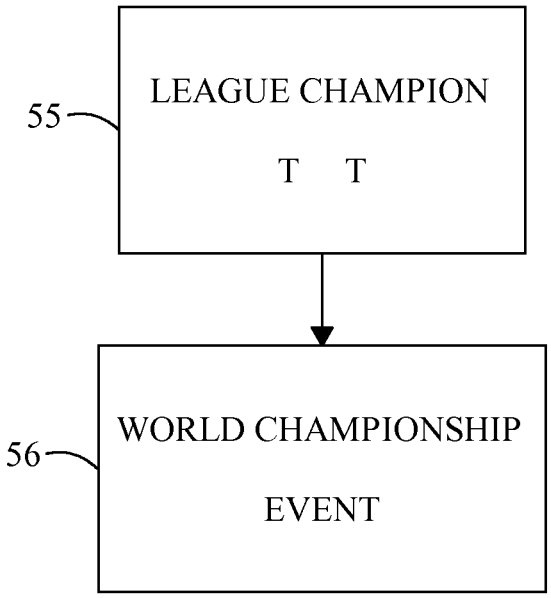

Having described the equipment, the game between cyclists has the following rules as described in FIGS. 2-4. All games occur on tracks no longer than 250 m and have no timed events. In a game, all of the races have a common finish line marked upon the track. The rules leading to a game champion appear in FIG. 2. All games have three teams, T, on the track at the same time as at 51. Each team has nine cyclists of preferably four sprinters, S, four long distance cyclists, L, and one substitute, SUB, as at 50. Once a substitute cyclist enters a race on behalf of an injured teammate, he completes the rest of the races of the game. Each team also has one manager, M, and one assistant, A. Each cyclist competes in no less than four races and no more than six races, except for the substitute.

Following a race, the cyclists receive points in their order of crossing the finish line. The points are awarded to the cyclists on behalf of their teams as follows, as at 52:

| | |
|---|---|
| $1^{st}$ place | 5 points |
| $2^{nd}$ place | 4 points |
| $3^{rd}$ place | 3 points |
| $4^{th}$ place | 2 points |
| $5^{th}$ place | 1 point. |

Each Game has up to ten races, as at 53. Each race will last no longer than twelve minutes from start to finish. Thus a full game will end in approximately two hours, the typical attention span of a television audience. Three minutes separate one race from the next. During a game, a half time occurs between the $5^{th}$ and $6^{th}$ race that lasts ten minutes. Select races will be sprints where the cyclists cover a short distance at maximum speed. The sprint races have lengths of 500 m, 1000 m, 2000 m, and Kierin. Select races will have the cyclists cover a long distance for time but with endurance. For the 500 m and Kieren races each team enters only two cyclists. The distance races have cyclists riding in a double elimination, or Miss & Out, for distances of 4000 m, 6500 m, 8000 m, 10000 m and Madison. In the Miss & Out race all cyclists must leave the track within one lap of being called out. Two select races will have both sprint and long distance cyclists: the relay-Madison race and the 10000 m Madison. Within each game, two required races will take place of short duration. The first race will be a 10,000 m Madison race, and the last race of every game will be a Madison Relay.

The team at the end of the tenth race with the most points becomes the winner of the game as at 54. The team with the second most point total enters second place and the team with the third most point total achieves third place. If any game ends with a tie between teams, the teams with the same score have a single race runoff. The runoff race has five cyclists from each team, who will compete in one race of ten laps. The scoring scheme 52 from the other races applies to the runoff race where the team scoring the most points wins the runoff and the game. The winning team of each game receives 4 points towards its league standings, the $2^{nd}$ place team receives 2 points towards its league standings and the $3^{rd}$ place team receives 1 point towards its league standings.

Each cyclist that completes a race has the points scored by each cyclist in each race added to their own individual league standings. Also, each cyclist receives credit for an assist if the cyclist leads a teammate for one lap or longer and that teammate scores points for his team. Assist points received serve as an additional individual league statistic. If any cyclist gains a lap on the field, then his team will receive double points. If any cyclist sets a track record, then his team receives double bonus points.

As a sport involving speed, equipment, and people, any dangerous riding or other behavior from a cyclist invokes severe consequences. The rules of the game provide that when a cyclist hooks another cyclist in the last 200 m of any race, the referees disqualify the hooking cyclist, and the scorer deducts three points his team's score. Further, any cyclist that draws two sanctions during one game becomes disqualified for the remainder of the game, his team loses an additional two points, and no substitute cyclist may take the disqualified cyclist's place. Penalty points for cyclists and teams become a separate statistical category and become a component for league standings. Any cyclist who delays a race for more than one minute will have one point deducted from his team's score, except for injuries as determined by the referees. Each referee has discretion to disqualify any cyclist who delays the start of the next race by more than two minutes.

In relay races, each teammate must touch another teammate to have a legal exchange. No more exchanges within a team may take place after the first cyclist from each team crosses the line for the final lap. Velodrome operators will ring a bell when the first cyclist of any team enters the third turn of the final lap and will continue ringing the bell until the last cyclist enters the same turn.

In races less than 2000 m, when cyclists endure a spill, that is, a crash, of more than half of the competing cyclists, the referees will start the race again from the beginning. Such a spill neutralizes a race and calls for restarting it. If any cyclist cannot ride in the second running of a race, then the team of that cyclist may select either a long distance cyclist or the substitute cyclist.

Velodromes usually include a riding surface having a steep bank. For shorter races, the bank works against cyclists self starting during a race. In the 250 m and 500 m races, league staff or velodrome operators will push start cyclists upon command of the starter. In each individual race, the starting position of the cyclists will be by lot where the lowest number drawn provides a cyclist with the pole position and the highest number drawn positions a cyclist next to the exterior of a track, often the track exterior has a balustrade adjacent to a wall. In team races, the cyclists line up on the balustrade on the backstretch and the race starts when they hit the starting line. But in Madison races, each team will line up along the balustrade with the relief cyclists in the back stretch.

Generally, any race of any game may have teams of only men, only women, or mixed gender teams of any age. Changing the length of the races, and the makeup of the teams accommodates the skill level of the cyclists. However, a league approved game never has more than ten races.

The relay-Madison race blends running relays of track with the Madison event of cycling. The Madison relay is the last race of each game which adds to the suspense of the game for the television audience. For a Relay-Madison, the race is thirty laps long with four cyclists per team: two sprinters and two long distance cyclists. Each race includes two teams from each country or city team, allowing for a total of six teams on the track at the same time. The sprinters will race four laps each and the long distance cyclists ride eight laps each. The first sprinter starts as in a normal race. However after three laps, they will get the bell and sprint for points that they will score for their respective teams. At the end of that sprint, the second sprinter receives a push start from the apron of the track and will make a Madison exchange with the cyclists that just completed the sprint. Each team will have two laps to make the exchange or receive a penalty. These two laps contribute towards the progress of the race, and are not neutral laps. As soon as the cyclists complete an exchange, the receiving cyclists accelerate to compete and to score points. As in the other Madison events, each of the cyclists must touch another teammate for a legal exchange. Then the long distance cyclists will race for eight laps and with one lap remaining the velodrome operators will ring the bell so the cyclists know to race for points. At the end of the first long distance portion of the race, the second long distance cyclist receives a push from velodrome operators into the track and the second exchange takes place within the next two laps. The second long distance cyclist follows the same as the first long distance cyclist, racing for eight laps with a points sprint at the end, where the final sprinter will get push started and race for four laps to receive their final points.

Having described the game for cyclists, velodrome operators, team managers, and cyclists form a league in FIG. 3. The league fosters competition between teams of cyclists to provide an interesting contest attractive to a television audience. Preferably, if a league, or IFTCL, starts with City against City franchises, the league creates divisions based upon the number of franchises in a given geographic area. The league then establishes regional championships then based upon the amount of franchises in any given region. From regional championships, the league then develops a world championship tournament. The preceding levels of championships occur under the supervision of a board of directors from league and franchisee staff and representatives from the participating cyclists.

Once a league of city vs. city franchises establishes itself, then the IFTCL will create country vs. country franchises and country vs. country competitions. Games that do not lead to a championship, so called "friendly" games, may take place at any time whether city vs. city or country vs. country format so long as the "friendly" game does not interfere with league play.

Alternatively, the league begins in its first year with teams from six countries. Each team then plays four games as previously described. When the fourth game concludes, the three teams with the highest point scores will play for the league championship and three with the lower scores play for fourth through sixth place. Then every four years, each NGB selects an "All Star Team" for its country and the All Star Team of cyclists represents their country in a worldwide competition of the league, I.F.T.C.L.

To start a league within an individual country, the league has at least four city teams as at **56*a*. Each city team races and plays twelve games in a season as at 51. When the teams grow to four in a geographic region, those teams then form a division within the league. The season also requires that each team compete against two teams from another country during the season. After the season, the top three teams in every league by score as at 52 enter a two game championship round as at 53. During the round, the team scoring the most points during the two games becomes the league and national champion as at 55. With leagues of four teams, the top two teams as at 55 qualify for a World Championship competition 56 as shown in FIG. 4**. When the teams expand into divisions, the five top teams will qualify for the World Championship competition.

From the aforementioned description, a method and game for cyclists has been described. The method and game for cyclists is uniquely capable of organizing cyclists into teams, divisions, and leagues that foster competition between individuals, teams, and countries that draws a television audience. The game identifies track lengths, equipment, and rules that establish teams that compete in the sport of cycling. The method and game for cyclists and its various components may call for equipment to be manufactured from many materials, including but not limited to, wood, steel, aluminum, polymers, polyvinyl chloride, high density polyethylene, polypropylene, ferrous and non-ferrous metals, their alloys, and composites, and open and closed cell foams.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A method of organizing cyclists for competitive sport, each of the cyclists riding a bicycle, comprising:

providing at least three teams of cyclists, each team having at least two sprinters, at least two long distance cyclists, and at least one substitute wherein each of said teams has a distinctive color;

providing each of said cyclists with a lighting device and a camera providing a curved track of approximately 250 meters in length with a finish line;

racing said at least three teams simultaneously upon said curved track in a race; and, awarding points to the first six of said cyclists who cross the finish line, said points accumulating for each cyclist and each team of cyclists;

wherein a game has no more than ten of said races;

said awarding points adding one point to a cyclist's score for an assist;

said awarding points doubling the points of each cyclist who passes the other cyclists by one lap;

said awarding points doubling the points of any cyclist who breaks the maximum speed record for a track;

said awarding points deducting three points from a team score for each cyclist hooking another, deducting two points from a team score for each cyclist drawing two penalties, or deducting one point from a team score for each cyclist who delays a game; and, said awarding points disqualifying a cyclist who draws two penalties during a game.

* * * * *